United States Patent [19]

Pingeton

[11] 4,104,816

[45] Aug. 8, 1978

[54] MULTI-FUNCTION LABEL AND CARRIER WEB

[75] Inventor: Charles Pingeton, Southbridge, Mass.

[73] Assignee: Doring Labels, Inc., Danielson, Conn.

[21] Appl. No.: 751,316

[22] Filed: Dec. 16, 1976

[51] Int. Cl.[2] ..... A44C 3/00

[52] U.S. Cl. ..... 40/2 R; 40/594; 428/41

[58] Field of Search ..... 428/913, 914, 41, 42; 40/2 R, 125 A

[56] References Cited

U.S. PATENT DOCUMENTS

| | | | |
|---|---|---|---|
| 2,139,377 | 12/1938 | Mull et al. | 40/2 R |
| 2,896,351 | 7/1959 | Johnson | 40/125 A X |
| 3,595,739 | 7/1971 | Meyer | 40/2 R X |
| 3,852,091 | 12/1974 | Newman | 428/914 X |
| 4,027,345 | 6/1977 | Fujisawa | 428/913 X |

*Primary Examiner*—Russel R. Kinsey
*Assistant Examiner*—Wenceslao J. Contreras
*Attorney, Agent, or Firm*—Brady, O'Boyle & Gates

[57] ABSTRACT

A multi-function label and carrier web including a label having permanent indicia on one face thereof and a pressure sensitive adhesive on the opposite face thereof, a carrier web having heat transferrable indicia on one face thereof and a release coating on the opposite face thereof, the label being mounted on the carrier web with the pressure sensitive adhesive being superimposed on the release coating face of the web.

4 Claims, 5 Drawing Figures

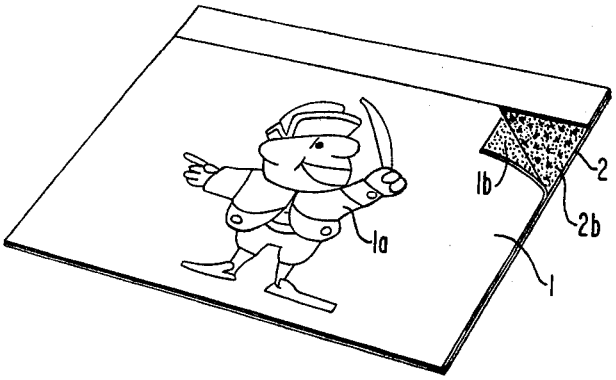
FIG 1
FIG 2
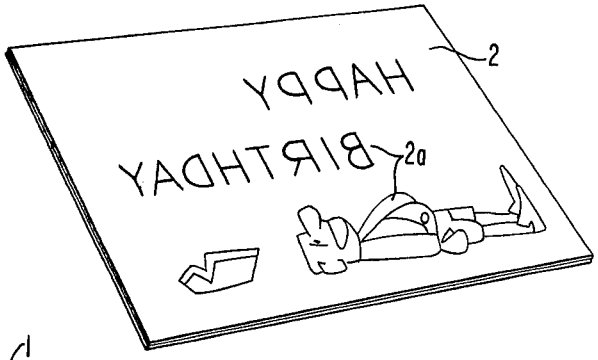
FIG 3
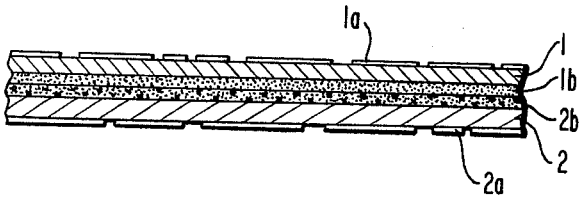
FIG 4
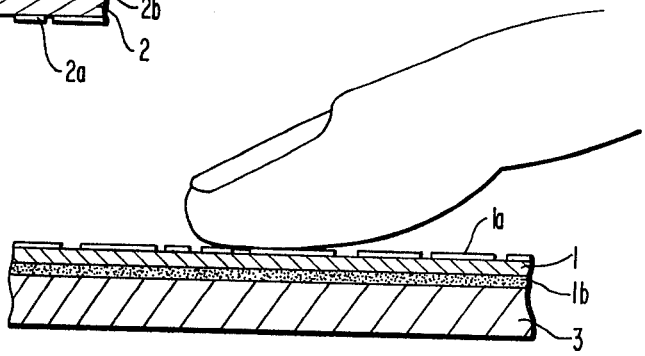
FIG 5
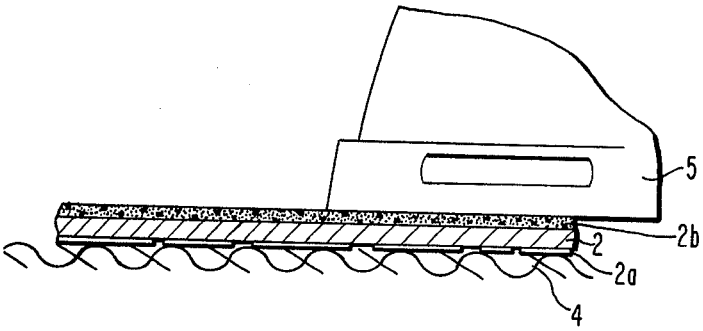

MULTI-FUNCTION LABEL AND CARRIER WEB

The subject matter of the instant application is contained in Disclosure Document No. 045743, filed Dec. 29, 1975.

BACKGROUND OF THE INVENTION

Heretofore, it has been known to provide labels with indicia on one face thereof and a pressure sensitive adhesive on the opposite face thereof, the labels being mounted on a carrier web from which the labels are adapted to be peeled and applied to a surface such as a package, container, and the like. After all the labels have been removed from the carrier web, the web is usually discarded.

It has also been known to provide sheets of paper with heat activated indicia wherein the indicia is transferred from the paper to a fabric surface, such as a skirt, when heat is applied to the reverse side of the paper sheet.

After considerable research and experimentation, the multi-function label and carrier web of the present invention has been devised which combined the concepts of a pressure sensitive adhesive label, a carrier web, and heat transferrable indicia into a single unit or assembly wherein the carrier web performs the two-fold function of a carrier for a label having a pressure sensitive adhesive on one face thereof, and as a carrier for heat transferrable indicia. The label and carrier web assembly of the present invention comprises, essentially, a carrier web having heat transferrable indicia on one face thereof, and a release coating on the opposite face thereof for protecting the pressure sensitive adhesive face of a label mounted thereon. By this construction and arrangement, the label can be peeled from the carrier web and adhered to another surface, and heat can be applied to the release coating face of the carrier web to cause the heat activated indicia to be transferred from the carrier web to another surface. When an appliance, such as a household iron or heat transfer press, is employed for applying heat to the heat activated indicia, the release coating acts as a lubricant to prevent the sticking of the iron or heat transfer press to the carrier web.

BRIEF DESCRIPTION OF THE DRAWINGS

FIG. 1 is a perspective view of the multi-function label and carrier web of the present invention showing one corner of the label being peeled from the carrier web;

FIG. 2 is a perspective view of the face of the carrier web having the heat transferrable indicia;

FIG. 3 is a sectional side elevational view of the label and carrier web;

FIG. 4 is a sectional side elevational view illustrating the application of the pressure sensitive adhesive label to a surface; and FIG. 5 is a sectional side elevational view illustrating the application of the heat activated indicia to a fabric surface.

DESCRIPTION OF THE PREFERRED EMBODIMENT

Referring to the drawings and more particularly to FIGS. 1, 2 and 3 thereof, the multi-function label and carrier web of the present invention comprises a label 1 having permanent indicia 1*a* on one face thereof and a pressure sensitive adhesive 1*b* on the opposite face thereof. The pressure sensitive adhesive label 1 is adapted to be releasably mounted on a carrier web 2 having heat tranferrable indicia 2*a* on one face thercof and release coating 2*b* on the opposite face thereof. As will be seen in FIG. 3, when the label 1 is mounted on the carrier web 2, the adhesive face 1*b* is superimposed on the release coating face 2*b*.

The particular printing inks employed for the indicia 2*a* may include a sublimable dye or a wax-based dye. A sublimable dye is one which vaporizes upon the application of heat and the gases of vaporization are then condensed and absorbed on an image receptor, such as a textile material. In a wax-based dye, the application of heat softens the wax and causes the indicia to adhere to the textile material.

In use, the pressure sensitive adhesive labels 1 are peeled from the carrier web 2 and are adhered to a surface 3 as shown in FIG. 4. Instead of discarding the carrier web, as was done heretofore when the label had been removed therefrom, the carrier web of the present invention can be placed on a fabric 4, as shown in FIG. 5, and heat applied to the transfer coating 2*b* by means of a heat transfer press or a household iron 5, whereby the heat activates the printing ink to thereby transfer the indicia to the fabric 4, the particular manner of transfer depending upon the type of dye in the ink, as described hereinabove. It will be appreciated by those skilled in the art that the heat transferrable indicia 2*a* is originally placed or printed on the carrier web in mirror image, as shown in FIG. 2, so that it becomes a real image or "right reading" when transferred to the fabric 4. It will also be appreciated by those skilled in the art that the release coating 2*b* not only protects the adhesive face of the label 1 when the label is mounted on the web, but it also acts as a lubricant to prevent the iron 5 from sticking to the web.

While the heat activated indicia 2*a* has been described as being "transferred" to the fabric 4, it is contemplated that this transfer of the image may be either total or partial; that is, the image may be completely transferred to the fabric, or a permanent image of the transferred indicia may be retained on the uncoated face of the carrier web.

The labels 1 and carrier web may be produced from paper, plastic film, metal foils, textiles, and the like, and the release coating 2*b* may be one of several types with silicone compounds being typical.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A multi-function label and carrier web comprising a label having indicia on one face thereof, an adhesive on the opposite face of said label, a non discardable carrier web having heat transferrable indicia on one face thereof, a release coating on the opposite face of said carrier web, said label being mounted on the carrier web with the adhesive face being superimposed on the release coating face of the web, whereby the label is adapted to be peeled from the carrier web and adhered to another surface, and the transferrable indicia is adapted to be transferred from the carrier web to yet another surface when heat is applied to the release coating face of the web, whereupon the carrier web may then be discarded.

2. A multi-function label and carrier web according to claim 1, wherein the adhesive is a pressure sensitive adhesive.

3. A multi-function label and carrier web according to claim 1, wherein the indicia is printed on the face of the carrier web with an ink having a sublimable dye, whereby upon the application of heat, the dye vaporizes and the condensed gases of vaporization are absorbed into said another surface.

4. A multi-function label and carrier web according to claim 1, wherein the indicia is printed on the face of the carrier web with a dye having a wax base, whereby upon the application of heat the wax becomes soft causing the indicia to adhere to said another surface.

* * * * *